US005102452A

United States Patent [19]

Taskinen et al.

[11] Patent Number: 5,102,452

[45] Date of Patent: Apr. 7, 1992

[54] METHOD FOR THE TREATMENT AND PRODUCTION OF FREE-FLOWING WC-NI-CO POWDERS

[75] Inventors: Pekka A. Taskinen, Espoo; Markku J. Kaskiala, Helsinki; Seppo T. Kemppinen, Ulvila; Jaana L. Niemelä, Helsinki; Heikki J. Volotinen, Espoo, all of Finland

[73] Assignee: Outokumpu Oy, Helsinki, Finland

[21] Appl. No.: 523,212

[22] Filed: May 14, 1990

[30] Foreign Application Priority Data

May 24, 1989 [FI] Finland ..... 892515

[51] Int. Cl.[5] ..... B22F 7/00; B22F 9/00

[52] U.S. Cl. ..... 75/342; 75/346; 75/351; 419/18; 419/23; 419/36; 419/37; 419/54

[58] Field of Search ..... 75/342, 346, 351, 352, 75/252; 419/18, 23, 36, 37, 53, 54, 57

[56] References Cited

U.S. PATENT DOCUMENTS 3,974,245 8/1976 Cheney et al. ..... 75/3367
4,626,477 12/1986 Jackson et al. ..... 420/431
4,872,904 10/1989 Dorfman ..... 75/352
4,886,638 12/1989 Penkunas et al. ..... 75/352

FOREIGN PATENT DOCUMENTS 1917 6/1983 PCT Int'l Appl. ..... 75/346

*Primary Examiner*—R. Dean
*Assistant Examiner*—Margery Phipps
*Attorney, Agent, or Firm*—Brooks Haidt Haffner & Delahunty

[57] ABSTRACT

The invention relates to a method for the treatment and production of material, particularly for the treatment and production of free flowing, finely divided metal powder or metal matrix composite powder. The material is composed of tungsten carbide and at least two components, nickel and cobalt. According to the method of the invention the composite powder is first mixed with the organic binder in order to form powder agglomerate, which powder agglomerate is further subjected to sintering treatment in order to remove the binder and to improve the mechanical strength of the composite powder. Further the composite powder is subjected to classification and the classified composite powder is thermally treated at a high temperature in an at least one-step thermal treatment in order to melt the composite powder at least partially, and in order to mix the various components to each other. For example, the material thermally treated by plasma is further cooled off in a free fall into material composed of essentially spherical particles.

7 Claims, No Drawings

METHOD FOR THE TREATMENT AND PRODUCTION OF FREE-FLOWING WC-NI-CO POWDERS

The present invention relates to a method for the treatment and production of material, particularly for the treatment and production of free flowing finely divided metal powder or metal matrix composite powder, which composite powder consists of several different components.

Free flowing powdered materials are usable in various connections within the field of metallurgy and ceramic materials. For instance, they can be used in manufacturing, by means of the injection moulding technique, the powder into compact objects, as well as in casting and coating treatments, such as flame and plasma spray techniques. Metallic and ceramic flame spray coatings are applied in many different products in order to improve their various properties such as hardness, wear resistance, lubricity, corrosion resistance and electric properties.

The powder materials meant for thermal spray processes must be homogeneous both as for composition and as for accurate particle size tolerances. In addition, these materials must be free flowing. In order to improve the free flowing capacity, the powders are usually micropelletized, in which case, however, the homogeneity of the obtained product is decreased.

The U.S. Pat. No. 4,588,608 introduces a coating method where the powdered coating material is suspended at a high temperature and with a high-velocity gaseous stream close to the melting temperature of the coating. The material used in the method contains 11.0–18.0% Co, 2.0–6.0% Cr, 3.0–4.5% C, and the balance is tungsten. The particle size of the coating material described in the patent is about 45 μm. According to the specificaton, for instance plasma arc technique can be used in the heating.

The U.S. Pat. Nos. 4,626,476 and 4,626,477 introduce materials suited to the above described coating method: in the U.S. Pat. No. 4,626,476, the material contains 4.0–10.5% Co, 5.0–11.5% Cr and 3.0–5.0% C, the balance being tungsten, whereas in U.S. Pat. No. 4,626,477 the composition is 6.5–9.0% Co, 2.0–4.0% Cr, 3.0–4.0% C, the balance W. The particle size of these coating materials also is about 45 μm.

Some production methods of free flowing material are described in the U.S. Pat. Nos. 3,909,241 and 3,974,245. The melting point of the powder material can be over 1,800° C., and the particle size about 40–60 μm. The method can be applied for instance for tungsten, molybdenum, chromium, tantalum and niobium and to compounds thereof, as well as for borides, carbides and nitrides. In the heating, there is advantageously applied plasma arc technique. While the powder is composed of several components, the various components are made to react so that the final product becomes homogeneous.

In the production method of fine spherical particles according to the EP patent application 259,844, the powder material is fed, along with the carrier gas, to a high temperature zone, where at least about 50% of the supplied powder melts and forms spherical particles. Thereafter the product is quickly cooled off in order to solidify the particles. As suitable materials, the patent application mentions metal-based materials, ceramic glasses, crystalline ceramic materials and combinations thereof. In the method of the EP patent application 259,844, the achieved sizes for the spherical particles, however, vary according to the material under treatment. For example, the particle size for the materials of the iron group defined in the said EP patent application is advantageously 20 μm, while for instance in the metal group including tungsten, molybdenium, niobium, tantalum and rhenium, as well as materials connected thereto, the majority of the spherical particles is below 50 μm in size. In the EP patent application 259,844, the high temperature zone is formed by means of plasma so that the temperature in the zone varies within the range of 5,500°–17,000° C.

In the known methods, there is usually treated material composed of a defined component, which material is then subjected to the high temperature treatment. Thus the final product is made homogeneous fairly easily, because the treatment of only one component is in question. While applying the state of the art methods for multicomponent systems, however, difficulties often arise as for the homogeneity and porosity of the final product. These difficulties are caused for example by too large particle sizes of the final product.

The object of the present invention is to eliminate some of the drawbacks of the prior art and to achieve a new and improved method for pretreating micropelletized powder agglomerate composed of several different components, and producing, at a high temperature, homogeneous, poreless structures with a small particle size, of materials that have a high melting point and are mixed only in the molten state. The essential novel features of the invention are enlisted in the patent claim 1.

In the method of the present invention, the micropelletized powder agglomerate composed of several different components is at least partly melted in conditions with a very high temperature so that both the chemical and physical homogenization of the powder agglomerate is achieved. The supply of the material to be treated into the high temperature treatment is carried out by means of a carrier gas, so that the evaporation of the material prior to the high temperature zone is avoided. In the high temperature treatment, the temperature is advantageously at least 2,500° C., and the treatment is performed in at least one step. In order to create the high temperature, plasma technique is advantageously made use of. For creating the said temperature, other suitable methods known as such in the prior art can also be applied without essentially weakening the invention. The particle size of the powder agglomerate used in the method of the present invention is within the range of 20–100 μm, advantageously 25–45 μm. At a high temperature, the various components of the powder are melted, and the compositions of the phases are advantageously changed. After the high temperature treatment, the treated material is cooled off in a free fall in a protective gaseous atmosphere. Thus the material treated according to the present invention is formed into a homogeneous, poreless final product composed of essentially spherical particles, the particle size whereof is advantageous to be used for instance in thermal spray processes.

In the method of the present invention, a high temperature treatment with two or more steps can also be applied. In that case the cooled product obtained from the previous high temperature treatment is conveyed, without intermediate treatment, to the following high temperature treatment. Thus the binder treatment connected to the method of the present invention is not needed in between two successive thermal treatments at a high temperature. By means of high temperature treatments with two or several steps, for instance the porelessness and the portion and size of the spherical particles can be improved.

While applying the method of the present invention, the required powder agglomerate is manufactured by mixing the raw materials of the composite powder to the organic binder of the agglomeration, and by carrying out the agglomeration so that the ratio between the particle sizes of the raw powders and the final product is at least 1:5. Thus the homogeneity of the final product is advantageously achieved.

The employed binder is for instance polyvinyl alcohol or stearic acid, the amount whereof is advantageously 1–4% by weight of the weight of the powder agglomerate. At the following stage, the agglomerate binder is removed, and the composite powder is subjected to presintering within the temperature range 900°–1,000° C. in order to improve its mechanical strength. Thus the composite powder can be classified for the high temperature treatment, for example into desired classes with advantageously narrow particle size ranges.

The method of the invention can be applied for instance to a composite powder made of tungsten carbide with a melting point of about 2,780° C. With such composite powders, the content of tungsten carbide is 80–90% by weight. Among the compound materials that simultaneously lower the melting point of pure tungsten carbide, let us mention for example cobalt, nickel and chromium, the contents whereof may vary as follows: 6–10% by weight cobalt, 0–10% by weight nickel and 0–4% by weight chromium.

EXAMPLE

According to the method of the present invention, there was treated, in a one-step thermal treatment, some tungsten carbide based composite powder containing 10% by weight cobalt and 4% by weight chromium as compound ingredients. In the high temperature treatment, there was used a direct-current plasma reactor with a 213 kWh output, and the employed plasma gas, 28 $Nm^3$, was nitrogen. The supply rate of the material under treatment was 25 kg/h, in which case the required amount of the carrier gas, nitrogen, was 2.4 $Nm^3/h$. After the treatment carried out at a high temperature, the material was cooled off. After the cooling carried out in a nitrogen atmosphere, at least 60% of the initial material was obtained as spherical particles in the final product, the majority of the particles having a particle size smaller than 30 μm. When the thermal treatment was carried out for the respective material in two steps at least 90% of the initial material was obtained as spherical particles which particle size was smaller than 30 μm. For the final product, there was defined both the apparent density and the Hall flow, which are essential properties while using the material for spray-technical purposes. The obtained Hall flow for the final product was 5.0.g/s, and the apparent density 5.7 $kg/dm^3$. The typical values achieved by employing the method of the present invention are, for instance as for the particle size distribution, clearly better than in the prior art, for instance as compared to those of the EP patent application 259,844.

We claim:

1. Method for the treatment and production of free flowing, finely divided metal powder or metal matrix composite powder composed of tungsten carbide and at least the metals nickel and cobalt comprising:

a) mixing powder raw material containing tungsten carbide and the metals nickel and cobalt with an organic powder binder in order to form powder agglomerate, b) subjecting the powder agglomerate to sintering treatment to produce a sintered product in order to remove binder and to improve mechanical strength of the raw material, c) subjecting the sintered product to classification, d) treating the product from classification thermally at a high temperature in an at least one-step thermal treatment in order to melt the powder at least partially, and in order to homogenize the powder, and e) cooling off the thermally treated powder in a free fall into material composed of essentially spherical particles.

2. The method of claim 1, wherein the raw material contains chromium.

3. The method of claim 1 wherein the raw material contains 80–90% by weight tungsten carbide, 6–10% by weight cobalt, 0–4% by weight chromium and 0.01–10% by weight nickel.

4. The method of claim 1 comprising mixing into the raw material an amount of binder, which is 1–4% of the amount of the raw material.

5. The method of claim 1, comprising thermally treating the product of step c at a temperature which is at least 2400° C.

6. The method of claim 1, comprising carrying out the thermal treatment of the product of step c by means of plasma.

7. The method of claim 1, wherein the majority of the spherical particles produced in step e are smaller than 30 μm in particle size.

* * * * *

UNITED STATES PATENT AND TRADEMARK OFFICE

CERTIFICATE OF CORRECTION

PATENT NO. : 5,102,452

DATED : April 7, 1992

INVENTOR(S) : Pekka A. Taskinen et al

It is certified that error appears in the above-identified patent and that said Letters Patent is hereby corrected as shown below:

Column 4, line 46 "least 2400°C." should read: --least 2500°C --.

Signed and Sealed this

Twentieth Day of July, 1993

*Attest:*

Michael K. Kirk

MICHAEL K. KIRK

*Attesting Officer*

*Acting Commissioner of Patents and Trademarks*